US005613545A

United States Patent [19]

Otsuka et al.

[11] Patent Number: 5,613,545

[45] Date of Patent: Mar. 25, 1997

[54] INERT GAS INJECTING PLATE BRICK OR INSERT NOZZLE BRICK FOR USE IN A SLIDING GATE VALVE APPARATUS OF MOLTEN METAL

[75] Inventors: Takashi Otsuka, Okayama; Kenji Yamamoto, Bizen; Mototsugu Osada, Bizen; Tadao Taniguchi, Bizen; Yoshifumi Shigeta, Bizen, all of Japan

[73] Assignee: Shinagawa Refractories Co. Ltd., Tokyo, Japan

[21] Appl. No.: 329,611

[22] Filed: Oct. 26, 1994

Related U.S. Application Data

[63] Continuation of Ser. No. 777,233, filed as PCT/JP89/00551 Jun. 1, 1989 published as WO90/14908 Dec. 13, 1990, abandoned.

[51] Int. Cl.[6] ..... B22D 11/00

[52] U.S. Cl. ..... 164/415; 164/259; 222/603

[58] Field of Search ..... 164/418, 475, 164/259, 66.1, 415, 437, 337; 222/600, 603; 266/236

[56] References Cited

U.S. PATENT DOCUMENTS

| | | | |
|---|---|---|---|
| 3,838,798 | 10/1974 | Vosu | 266/236 |
| 4,103,732 | 8/1978 | Habert | 164/418 |
| 4,520,860 | 6/1985 | Haissig | 164/415 |
| 4,588,112 | 5/1986 | Kondo | 164/415 |
| 4,828,460 | 5/1989 | Saito | 164/500 |

FOREIGN PATENT DOCUMENTS

| | | | |
|---|---|---|---|
| 383529 | 7/1987 | Austria . | |
| 0080997 | 6/1983 | European Pat. Off. . | |
| 171589 | 2/1986 | European Pat. Off. | 164/415 |
| 2227073 | 11/1974 | France . | |
| 2334452 | 7/1977 | France . | |
| 2407772 | 10/1978 | France . | |
| 3634893 | 3/1988 | Germany | 164/437 |
| 53-123336 | 10/1978 | Japan . | |
| 0020938 | 7/1979 | Japan | 222/603 |
| 0021157 | 2/1985 | Japan | 164/437 |
| 61-20659 | 1/1986 | Japan | 164/415 |
| 0165266 | 7/1986 | Japan | 164/437 |
| 61-195734 | 8/1986 | Japan . | |
| 62-130753 | 6/1987 | Japan | 164/415 |
| 0309768 | 12/1989 | Japan | 164/437 |

OTHER PUBLICATIONS

Patent Abstracts of Japan, vol. 12, No. 416 (M–759) (3263), 4th Nov. 1988; & JP–A–63 154247 (Kawasaki) 27 Jun. 1988.

*Primary Examiner*—Joseph J. Hail, III
*Assistant Examiner*—James Miner
*Attorney, Agent, or Firm*—Larson and Taylor

[57] ABSTRACT

This invention relates to an inert gas injecting plate brick or nozzle brick for use in a sliding gate valve apparatus of molten metal, characterised in that said plate brick or insert nozzle brick is horizontally split into at least two parts, and a number of small diameter pipes are sealingly arranged and secured in said split surfaces. According to such a plate brick or nozzle brick, it is possible to prevent leakage of injection gas in such kind of apparatus, it is possible to carry out a stable casting working, and complicated, high cost, additional processes such as cutting working, boring working and connecting working of said bricks can be saved.

10 Claims, 3 Drawing Sheets

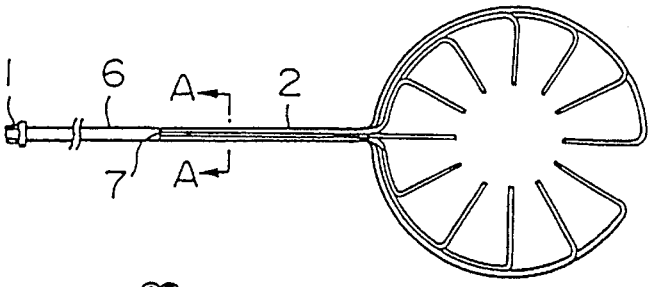
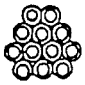
FIG. 3(a)
FIG. 3(b)
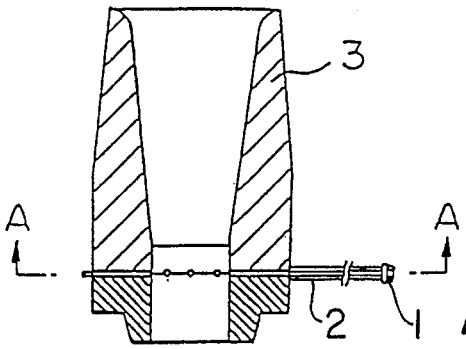
FIG. 4(a)
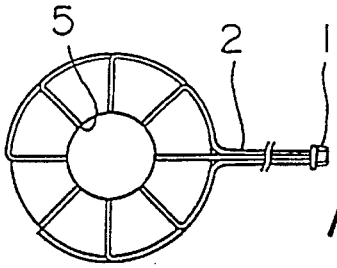
FIG. 4(b)
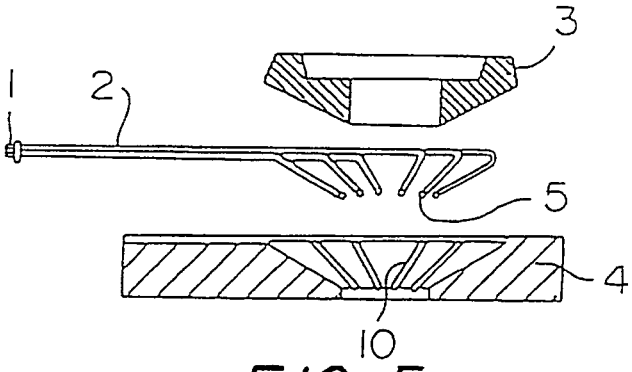
FIG. 5

FIG. 6(a)
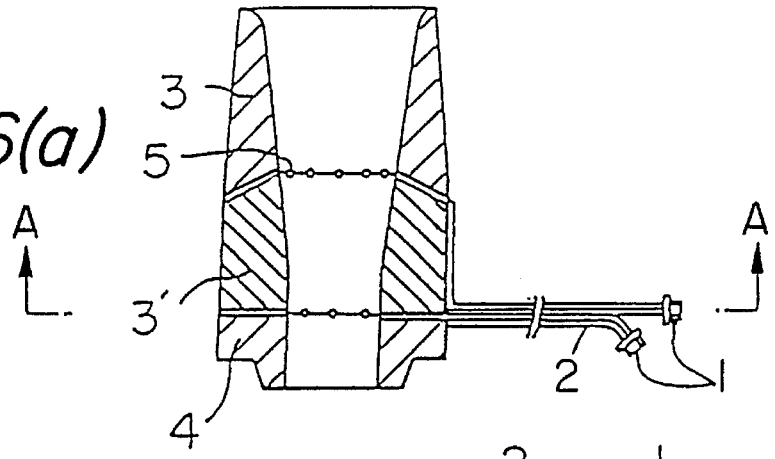
FIG. 6(b)
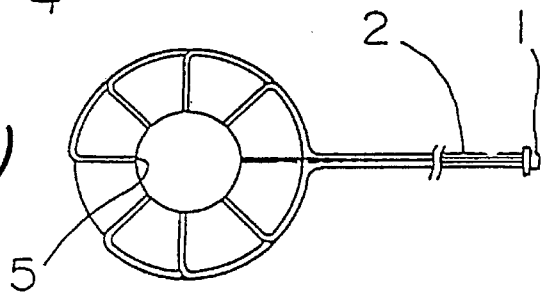
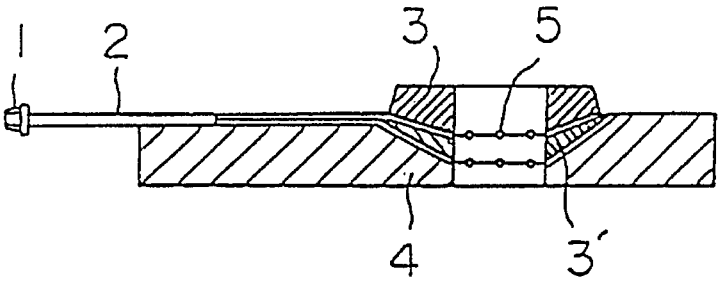
FIG. 7
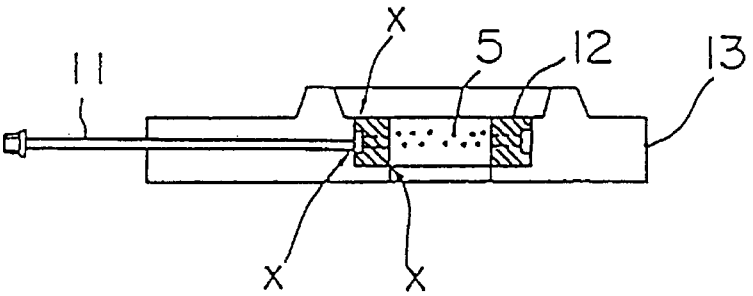
FIG. 8

INERT GAS INJECTING PLATE BRICK OR INSERT NOZZLE BRICK FOR USE IN A SLIDING GATE VALVE APPARATUS OF MOLTEN METAL

This application is a continuation of application Ser. No. 07/777,233, filed as PCT/JP89/00551, Jun. 1, 1989 published as WO90/14908 Dec. 13, 1990 now abandoned.

TECHNICAL FIELD

This invention relates to an inert gas injecting plate brick or insert nozzle brick for use in a sliding gate valve apparatus (or discharge regulator) of molten metal.

BACKGROUND TECHNIQUE

In a continuous casting installation, the molten metal received at a ladle is poured into a mold through a tundish. At such a time, a certain amount of molten metal is kept stored within the tundish before starting the pouring of the molten metal into the mold at the beginning of casting, and after the flowing-up of impurities a nozzle is opened to start a pouring. This procedure is called a closed start, and these days this technique has begun to be introduced.

In the closed starting of a continuous casting tundish various systems have been proposed for injecting an inert gas to prevent the molten metal from solidification within the nozzle while storing the molten metal in the tundish by closing the nozzle hole of a sliding porous refractory, and a system (shown in FIG. 8—Patent Kokai No. 177952/85) in which a gas injecting ring is arranged, said ring having a plurality of small radial orifices provided toward the slide plate side from a groove formed along the outer periphery within the opening of a bottom plate brick to the center of the opening.

Said known systems have the following drawbacks:

a) The gas guiding pipe (made of copper or steel) is connected and sealed with the gas feeding holes (made of brick bored with fine orifices) by means of sealing material, mortar or soldering, and in the high temperature condition the gas sometimes leaks (shown with x marks in FIG. 8) from the joints so as not to be injected into the nozzle opening.

Further, practically the gas amount injected into the nozzle opening becomes irregular so that stable casting is often not operated whereby the products and quality are not uniform.

b) The making process requires additional working such as a cutting processing of brick, a boring processing of brick, and a jointing working of the gas guiding pipe and the gas injecting brick thereby to demand high cost.

DISCLOSURE OF THE INVENTION

The inventors of this invention have made extensive studies and researches to solve the various problems innate in the known systems, and as the result, they have been successful in developing a novel inert gas injecting plate brick or insert nozzle brick for use in a sliding gate valve apparatus of molten metal, which brick is of quite different idea from the known systems.

The present invention is technically constituted such that a plate brick or insert nozzle brick for use in an apparatus of discharging molten metal is split into at least two parts horizontally, said split surfaces are provided with a number of small diameter pipes (2) in the sealed state, and said pipes are secured to said split surface, and said small diameter pipes are communicated with a gas passing portion. By means of such technical constitution it is possible to achieve the undermentioned function and effect.

a) The gas passing route where gas is likely to leak and where the temperature is likely to rise in the vicinity of the nozzle opening, is made in one body without joints so that the gas does not leak out, and therefore, the whole gas as fed is injected into the nozzle opening.

b) After the formation of the plate brick or nozzle brick by pressing, the additional working such as cutting processing or boring processing is no longer required, so that cost decreases.

BRIEF DESCRIPTION OF THE DRAWINGS

FIG. 1*a* is a partly notched plan view; FIG. 1*b* is a vertical sectional view taken along the A—A line of FIG. 1*a;*

FIG. 3*a* and FIG. 3*b* show an embodiment of the gas guiding pipes (in the case of plurality) which are incorporated in the brick, and FIG. 3*b* is a sectional view taken along the A—A line of FIG. 3*a;*

FIG. 4*a* and 4*b* show an embodiment in which the gas guiding pipes are incorporated in an insert nozzle brick, and FIG. 4*a* is a vertical sectional view while FIG. 4*b* is a lateral sectional view taken along the A—A line of FIG. 4*a;*

FIG. 5 is a partly sectional side view showing the respective members in the embodiment of FIG. 1;

FIG. 6*a* and FIG. 6*b* are views, similar to FIG. 4, of an example of three-split type, where the present invention is applied to the insert nozzle brick;

FIG. 7 is a vertical sectional view of an embodiment of three-split type, where the invention is applied to the plate brick; and FIG. 8 is a vertical sectional view of a bottom plate brick for the injection of inert gas of known system.

BEST EMBODIMENT FOR CARRYING OUT OF THE INVENTION

The invention will now be described more in detail, by way of embodiment, with reference to the accompanying drawings.

Figure 1A:
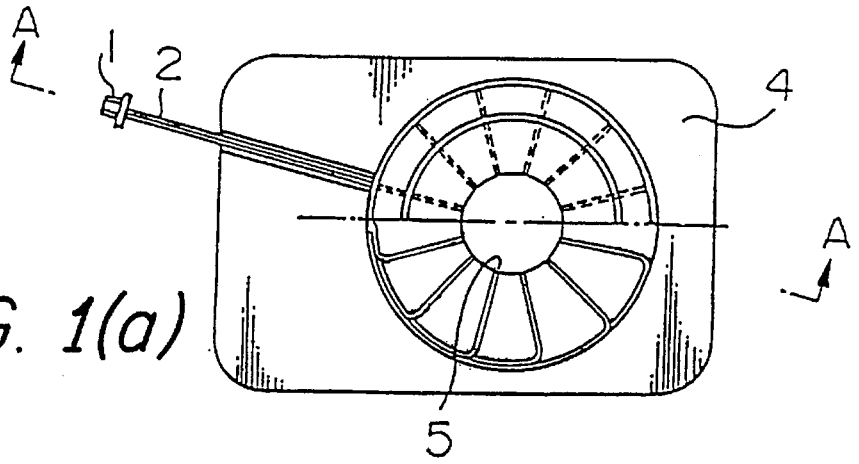
FIG. 1*a* and 1*b* show one embodiment of the invention, in which the gas guiding pipes are incorporated in the normal direction of and obliquely downward to the nozzle opening of the plate brick.
Figure 1B:
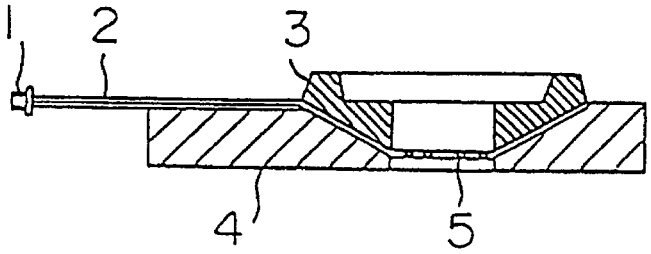

FIG. 1 shows an embodiment in which the present invention is applied to a bottom plate brick. As shown, said plate brick is split into bricks 3 and 4, a number of small diameter pipes 2 each having a connecting port 1 to the gas source are involved and arranged in the jointing surfaces of said split bricks 3 and 4, and gas injecting openings 5 of said small diameter pipes 2 in group communicate with the melt passing hole.

Figure 2A:
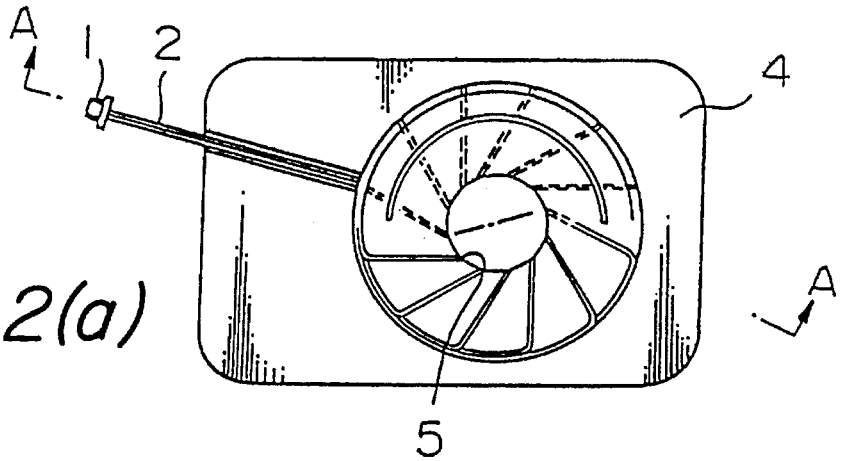
FIG. 2*a* and FIG. 2*b* are also a plan view and a vertical sectional view, similar to FIG. 1, which shows a different embodiment of the invention, in which the gas guiding pipes are incorporated in the normal direction of and obliquely downward to the nozzle opening of the plate brick.
Figure 2B:
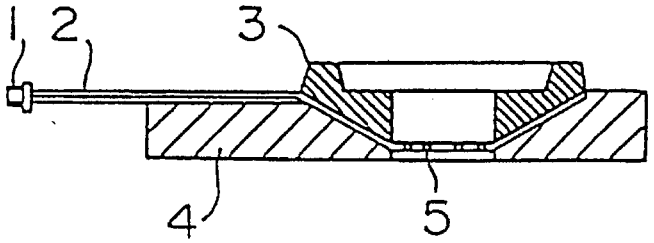

FIG. 2 is similar in construction to FIG. 1, and it is an embodiment in which the gas injecting direction of the small diameter pipe 2 is brought close to the normal direction of the outer periphery of the melt passing hole. FIG. 2 is similar to FIG. 1 in other constitution.

FIG. 3*a* is a plan view showing an assembling mode of the group of said small diameter pipes 2, and FIG. 3*b* shows a sectional view of the group of said small diameter pipes 2 in the bound state.

FIG. 4 is an embodiment in which the present invention is applied to an insert nozzle brick. In this embodiment, the insert nozzle brick is split into bricks 3 and 4, a group of the small diameter pipes 2 are involved and arranged, similarly to the above, in the split surfaces, and gas injecting openings 5 communicate with the melt passing hole.

FIG. 5 is a sectional view where respective parts in the embodiment of FIG. 1 are separately shown thereby to exemplify their arranging relationship.

FIG. 6 shows an embodiment in which the insert nozzle brick is split into three parts (3, 3' and 4), and the gas injecting openings 5 are disposed in two rows of upward and horizontal directions in the melt passing hole.

FIG. 7 shows an embodiment in which similarly, the insert nozzle brick is split into three parts (3, 3' and 4), and the injecting openings 5 are disposed also in two rows up and down.

FUNCTIONS

A plate brick or an insert nozzle brick which is used in a sliding gate valve apparatus of molten metal is split into two or more parts, several slender stainless or copper pipes are arranged in the split surfaces toward the nozzle opening, and thereafter the split plate bricks or insert nozzle bricks are adhered with mortar or the like.

1) One of the two split bricks is press formed by providing grooves 10 for embedding the pipes. The brick material is the high alumina or alumina carbonaceous one which is generally used as plate brick or insert nozzle brick. Additionally, in the case of pipes the outside diameter of which is more thin than the mortar joint, it is unnecessary particularly to provide grooves for embedding the pipes.

2) The other of the two split bricks is not provided with the grooves for embedding the pipes, and it consists of a press formed article or a casting material. The material is the same as in 1) above.

3) For making a gas guiding pipe, a copper or stainless pipe of about 0.2–3.00 mm inside diameter is bend worked in advance to meet the shape of the groove of the brick. In the case of a plurality of pipes, they are assembled in a single pipe by soldering or the like and a nipple for connection is secured to the tip of said assembled pipe.

4) In the case of a plurality of pipes, the inside diameter, length and securing position of each of the pipes are varied in consideration of the pressure loss caused by the difference of the lengths of the respective pipes, so that the gas may be injected uniformly into the nozzle hole.

5) In order that the pressure loss of the pipes is decreased, the inside diameter of the pipes is made larger except the gas injecting port portions of the pipe. Further, in case the pipes are two or more, they are combined and connected to a single larger pipe whereby the pressure loss is decreased (see FIG. 3).

EFFECTS OF THE INVENTION (1) Since the inert gas fed into the pipes passes through a jointless piping so as to be injected into the nozzle hole, the gas cannot be leaked and it is possible to feed the gas in a certain amount.

In known techniques, for example, a cylindrical brick bored with fine orifices was set to a plate brick and a metallic pipe was connected to the gas reservoir provided therebetween. However, gas leakage could not be prevented being affected by the heat generated from the molten metal when casting.

(2) Since the plate brick itself does not form a part of the gas passing route it is unnecessary that the brick is machine worked to form a gas passage there. Because of this, the brick as press formed can be used as it is to allow the manufacturing process to be simplified. This leads to a cost lowering.

(3) By varying the size, number, position and angle of the pipes it is possible to easily manufacture bricks of the constructions suited for closed start and blocking prevention respectively.

We claim:

1. An inert gas injecting plate brick for use in a sliding gate valve apparatus of a closed start pouring system wherein an amount of molten metal is stored in a tundish prior to pouring of the molten metal into a mold at the beginning of casting, said plate brick being horizontally split into at least two parts to form split surfaces, and said plate brick including a plurality of small diameter pipes sealingly arranged and secured in said split surfaces, said small diameter pipes being bundled together in a plurality of groups, and each group of the pipes being in communication with a gas passing portion.

2. An inert gas injecting plate brick as claimed in claim 1 wherein said small diameter pipes are disposed so as to extend in a direction between a normal and a tangent to a melt passing opening of the brick.

3. An inert gas injecting plate brick as claimed in claim 1 wherein said small diameter pipes are made of metal.

4. An inert gas injecting plate brick as claimed in claim 1 wherein said small diameter pipes are made of ceramic.

5. An insert nozzle brick for use in a sliding gate valve apparatus of closed start pouring system wherein an amount of molten metal is stored in a tundish prior to pouring of the molten metal into a mold at the beginning of casting, said insert nozzle brick is being horizontally split into at least two parts to form split surfaces, and said insert nozzle brick including a plurality of small diameter pipes sealingly arranged and secured in said split surfaces, said small diameter pipes being bundled together in a plurality of groups, and each group of the pipes being in communication with a gas passing portion.

6. An insert nozzle brick as claimed in claim 5 wherein said small diameter pipes are disposed so as to extend in said insert nozzle brick in a direction between a normal and a tangent to a nozzle opening.

7. An insert nozzle brick as claimed in claim 5 wherein said small diameter pipes are made of metal.

8. An insert nozzle brick as claimed in claim 5 wherein said small diameter pipes are made of ceramic.

9. An inert gas injecting plate brick for use in a sliding gate valve apparatus of a closed start pouring system wherein an amount of molten metal is stored in a tundish prior to pouring of the molten metal into a mold at the beginning of casting, said plate brick being horizontally split into at least two parts to form split surfaces, and said plate brick including a plurality of small diameter pipes sealingly arranged and secured in said split surfaces, said small diameter pipes being in communication with a gas passing portion, and groups of said small diameter pipes being disposed at spaced locations along a metal passing opening in said brick.

10. An insert nozzle brick for use in a sliding gate valve apparatus of closed start pouring system wherein an amount of molten metal is stored in a tundish prior to pouring of the molten metal into a mold at the beginning of casting, said insert nozzle brick is being horizontally split into at leas parts to form split surfaces, and said insert nozzle brick including a plurality of small diameter pipes sealingly arranged and secured in said split surfaces, said small diameter pipes being in communication with a gas passing portion, and groups of said small diameter pipes being disposed at spaced vertical locations along a nozzle opening in said insert nozzle brick.

* * * * *